United States Patent [19]

Mlaker et al.

[11] Patent Number: 4,917,214

[45] Date of Patent: Apr. 17, 1990

[54] AERIAL LIFT BUCKET ROTATION DEVICE INCLUDING BUCKET LEVELING MEANS

[75] Inventors: John J. Mlaker, Milwaukee; William K. Holmes, Delafield, both of Wis.

[73] Assignee: Hi-Ranger, Inc., Waukesha, Wis.

[21] Appl. No.: 394,753

[22] Filed: Aug. 16, 1989

[51] Int. Cl.[4] ..... B66F 11/04

[52] U.S. Cl. ..... 182/2

[58] Field of Search ..... 182/2

[56] References Cited

U.S. PATENT DOCUMENTS

| | | | |
|---|---|---|---|
| 2,996,140 | 8/1961 | Troche et al. | 182/2 |
| 3,108,656 | 10/1963 | Asplundh | 182/2 |
| 3,132,718 | 5/1964 | Pierce | 182/2 |
| 3,159,240 | 12/1964 | Miller | 182/2 |
| 3,467,217 | 9/1969 | Zwight | 182/2 |
| 3,809,180 | 5/1974 | Grove | 182/2 |
| 3,841,436 | 10/1974 | Grove | 182/2 |
| 3,937,340 | 2/1976 | Grove | 214/147 |
| 4,271,926 | 6/1981 | Cullity | 182/2 |
| 4,326,601 | 4/1982 | Grove et al. | 182/2 |
| 4,334,594 | 6/1982 | Jost | 182/2 |
| 4,512,436 | 4/1985 | Freudenthal et al. | 182/2 |

FOREIGN PATENT DOCUMENTS

| | | | |
|---|---|---|---|
| 1337059 | 11/1973 | United Kingdom | 3/16 |

*Primary Examiner*—Reinaldo P. Machado
*Attorney, Agent, or Firm*—Michael, Best & Friedrich

[57] ABSTRACT

An aerial lift including an improved structure for supporting the bucket or platform and compensating for changing forces on the bucket support structure as the bucket rotates from a side hung position to a forward position. The compensating structure provides for leveling of the bucket when the bucket rotates from the side hung position to the forward position and such that the bucket will be maintained level in both the side hung position and the forward position.

9 Claims, 2 Drawing Sheets

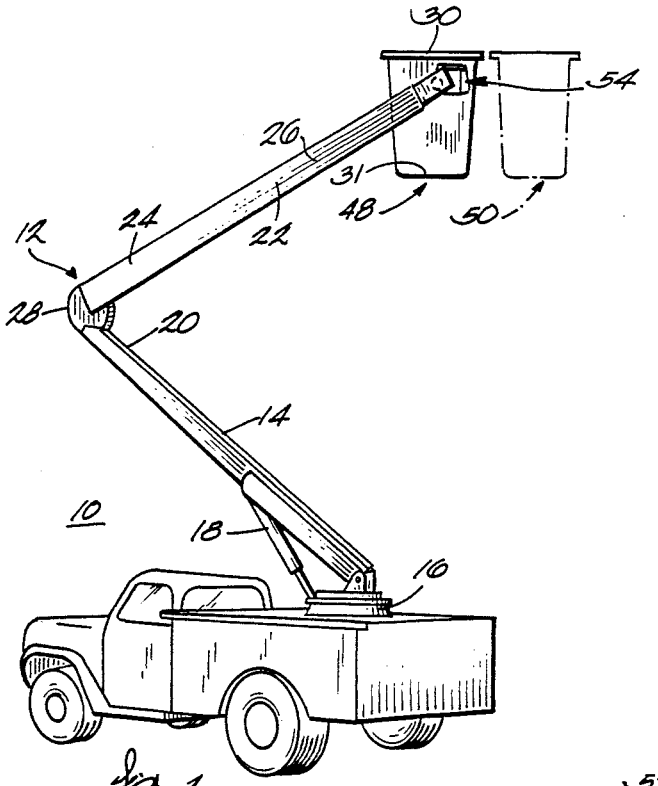
Fig. 1
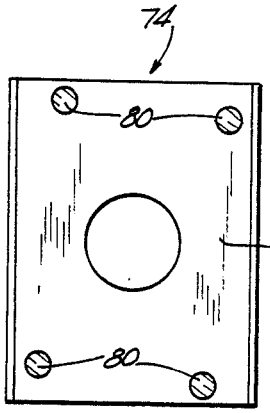
Fig. 5
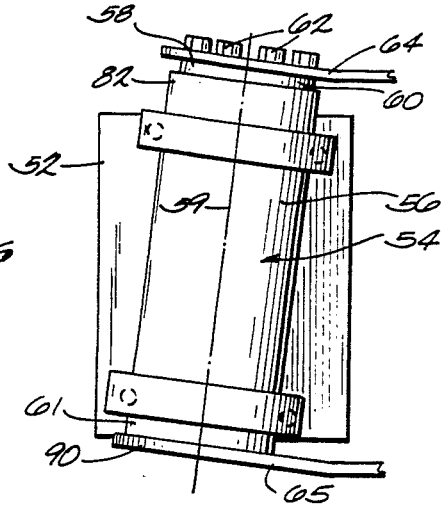
Fig. 6
Fig. 2.
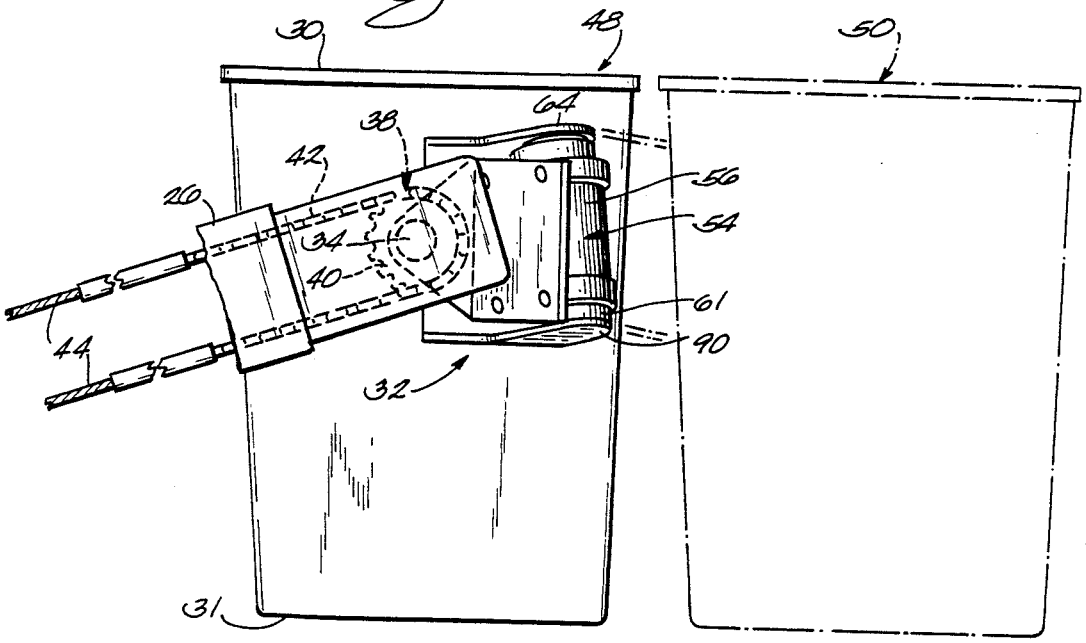

AERIAL LIFT BUCKET ROTATION DEVICE INCLUDING BUCKET LEVELING MEANS

FIELD OF THE INVENTION

The invention relates to aerial lifts and apparatus for supporting the bucket of an aerial lift for rotation between a side hung position and a forward extended position.

BACKGROUND PRIOR ART

Aerial lifts having an extensible boom commonly include an operator platform or bucket which is rotatable between a side hung or side mounted position wherein the bucket is positioned at the side of the boom and a forward or extended position.

In many prior art arrangements a bucket leveling system is employed for maintaining the bucket generally level as the upper boom angle varies during movement of the upper boom. These bucket leveling systems commonly include a pivot pin for supporting the bucket, the pivot pin being supported for limited pivotal movement about a horizontal axis perpendicular to the longitudinal axis of the upper boom. A sheave or sprocket is fixed to the pivot pin and cables or chains with insulated rods are housed in the boom and cause adjustable movement of the sheave and pivot pin in response to movement of the upper boom and changes in the relative angle of the upper boom with respect to horizontal. In those applications where the bucket is mounted for pivotal movement around a vertical axis between a side hung position and a forward extended position, when the bucket is in the side hung position, the center of gravity of the bucket is generally in line with the horizontal axis of rotation of the bucket supporting pin or pivot pin. During movement of the bucket forwardly to the extended position, the center of gravity of the bucket moves forwardly, and the moment arm between the center of gravity of the platform or bucket and the pivot pin increases in length. Accordingly, the torque on the pivot pin of the leveling system increases, and the cable and insulated rods in the boom are stretched and the bucket tends to deflect downwardly or tilt forwardly. Such a forward tilt of the bucket may make the bucket uncomfortable for the operator because the floor of the bucket is not maintained level.

In one prior art arrangement, applicants have employed a hydraulic rotary actuator to provide for rotation of the bucket between the side hung position and the forward position. The rotary actuator is supported such that it has a vertical axis of rotation. The rotary actuator is supported by a bracket fixed to the horizontal pivot pin. In one prior arrangement the bracket includes a vertical surface for supporting the rotary actuator, that surface defining an angle of approximately 45° with respect to the axis of the horizontal pivot pin and such that the rotary actuator rotates the bucket 45° rearwardly to the side hung position and 45° forwardly to the forward position.

SUMMARY OF THE INVENTION

The present invention includes an aerial lift including an improved means for supporting a bucket and providing means for compensating for changing forces on the means for supporting the bucket as the bucket rotates from a side hung position to a forward position. The means for compensating provides for leveling of the bucket when the bucket rotates from the side hung position to the forward position such that the bucket will be maintained level in both the side hung position and the forward position.

More particularly, the invention includes an aerial lift including a boom, a platform supported by the boom, and means for maintaining the platform generally level during elevation or articulation of the boom. The leveling means includes a means for supporting the platform for pivotal movement about a horizontal pivot axis perpendicular to the center line of the boom. Means are further provided for mounting the platform to the end of the boom such that the platform can be pivoted around a generally vertical axis between a side hung position wherein the Platform is located laterally of the end of the boo and a forward position. The means for mounting the platform includes a support member supported by the boom and supporting a rotary actuator having a central axis of rotation such that the central axis of rotation of the rotary actuator lies in a generally vertical plane perpendicular to the horizontal line generally bisecting the angle defined by the center line of the boom and the horizontal pivot axis, and wherein the central axis of rotation of the rotary actuator is inclined upwardly and rearwardly toward the horizontal pivot axis of the platform and outwardly away from the center line of the upper boom.

In one embodiment of the invention the means for maintaining the bucket level includes a generally horizontal pivot pin supported by the boom, and a bracket supported by the pivot pin, the bracket including a portion supporting the rotary actuator. The bracket includes a rotary actuator support surface defining a generally vertical plane perpendicular to the line generally bisecting the angle defined by the center line of the boom and the horizontal pivot axis of the bracket.

In one preferred embodiment of the invention the rotary actuator is mounted on the support surface of the bracket such that the central axis of rotation is generally parallel to the plane of the support surface and is inclined at an acute angle with respect to a generally vertical line bisecting the support surface.

Various other features and advantages of the invention will be apparent by reference to the following description of a preferred embodiment, from the drawings and from the claims.

BRIEF DESCRIPTION OF THE DRAWINGS

FIG. 1 is a perspective view of a truck mounted aerial lift embodying the invention.

FIG. 2 is an enlarged partial elevation view of a portion of the aerial lift illustrated in FIG. 1.

FIG. 5 is a cross section view taken along line 5—5 in FIG. 3.

FIG. 6 is a cross section view taken along line 6—6 in FIG. 3.

Figure 3:
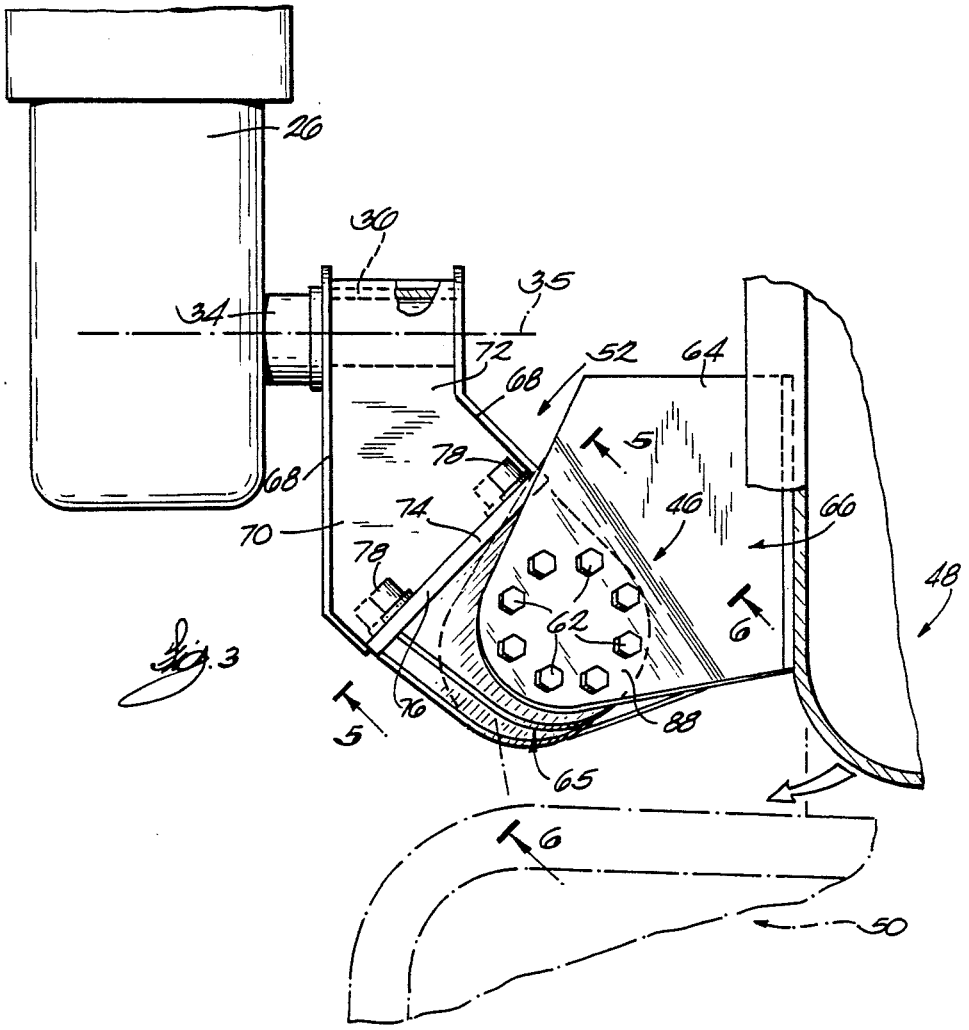
FIG. 3 is an enlarged plan view of a portion of the upper end of the aerial lift boom and bucket support structure illustrated in FIG. 2.

Before describing a preferred embodiment of the invention in detail, it is to be understood that the invention is not limited to the details of construction and to the arrangement of the components set forth in the following description or illustrated in the drawings. The invention is capable of other embodiments and of being practiced and carried out in various ways. Also it is to be understood that the phraseology and terminology employed herein is for the purpose of description and should not be regarded as limiting.

DESCRIPTION OF A PREFERRED EMBODIMENT

Illustrated in FIG. 1 is a truck mounted aerial lift 10 including an articulated boom assembly 12 having a lower boom 14 supported for rotation about a vertical axis by a platform or turntable 16. The lower boom 14 is pivotally connected to the turntable 16 for pivotal movement about a horizontal axis and is supported by a hydraulic cylinder 18. The upper end 20 of the lower boom 14 supports an upper boom 22, the upper boom 22 having opposite ends 24, 26, one lower end 24 pivotally connected by an elbow 28 to the upper end 20 of the lower boom 14. The opposite upper end 26 of the upper boom 22 supports a bucket 30 or platform having a floor 31 of the type adapted to carry a workman.

Means 32 are also provided at the upper end 26 of the upper boom 22 for supporting the bucket 30 or platform for pivoting movement about a horizontal axis such that the bucket 30 is maintained level during movement or articulation of the upper and lower booms 22, 14. During articulation of the boom assembly 12 to effect movement of the bucket or platform 30, the angle of the upper boom 22 with respect to horizontal changes. The means 32 for supporting the bucket 30 for pivotal movement about a horizontal axis provides a means for maintaining the bucket 30 relatively level during such extension or retraction of the boom assembly 12. The means 32 for supporting the bucket 30 includes a horizontal pivot pin 34 or shaft supported by the upper end 26 of the upper boom 22 such that the pivot pin 34 can pivot about its central longitudinal axis 35. The horizontal pivot pin 34 includes an outer end or extending portion 36 adapted to support the bucket or platform 30. Means 38 are also provided for causing pivotal movement of the pivot pin 34 and leveling movement of the bucket 30 in response to articulation of the upper and lower booms 22, 14. This means 38 for causing pivotal movement includes a sprocket 40 housed in the upper end 26 of the upper boom 22, surrounding the pivot pin 34 and fixed to the pivot pin 34. A chain 42 extends around the sprocket 40 and opposite ends of the chain 42 are joined to cables and or insulated rods 44 of a conventional bucket leveling system.

The operation of a bucket leveling system of the type used in aerial lifts is illustrated in greater detail in U.S. patent application Ser. No. 036,009, filed Apr. 8, 1987 and the disclosure of that patent application is incorporated herein by reference.

Means 46 are also provided for supporting the bucket or platform 30 for pivotal movement from a side hung position 48 wherein the bucket 30 is located adjacent the side of the upper end 26 of the upper boom 22 as illustrated in solid lines in FIGS. 1–3 and an extended position or forward position 50 as illustrated in phantom in those figures.

The means 46 for supporting the bucket 30 for pivotal movement includes an actuator bracket 52 fixed to the projecting or extending end 36 of the pivot shaft or pin 34 for rotation with the pivot shaft 34. The means 46 for supporting the bucket 30 for pivotal movement also includes an actuator 54 for causing pivotal movement of the bucket 30. While other devices could be provided for causing pivotal movement of the bucket 30, in the illustrated arrangement, a hydraulic rotary actuator 54 is supported by the bracket 52 and is connected to the bucket 30 by support means 46. The hydraulic rotary actuator 54 includes an outer cylinder 56 which can be fixed to the bracket 52 and includes a central rotatable shaft 58 rotatable about the central longitudinal rotational axis 59 of the cylinder 56. The central rotatable shaft 58 has an upper end 60 and a lower end 61 which are fixed by bolts 62 to the upper flange 64 and the lower flange 65, respectively, of a bracket 66, which in turn, supports the bucket 30. The hydraulic rotary actuator 54 includes a conventional internal configuration which provides for rotation of the central rotatable shaft 58 in response to application of hydraulic fluid pressure to the opposite ends of the cylinder 60. Because the construction of the rotary actuator 54 is conventional, it will not be described in detail.

While the actuator bracket 52 could have other configurations and could be constructed in other ways, in the illustrated arrangement the actuator bracket 52 includes a pair of spaced apart angular plates 68 joined by one or more webs 70. The plates 68 and an end portion 72 of the webs 70 are fixed to the pivot shaft 34. The actuator bracket 52 also includes a mounting plate 74 supported by the angular plates 68 and the webs 70, the mounting plate, in the particular embodiment illustrated, being located forwardly of the pivot shaft 34 and spaced laterally of the center line of the boom 22. The mounting plate 74 is supported such that it defines a rotary actuator mounting surface 76 defining a generally vertical plane perpendicular to the horizontal line generally bisecting the angle between the center line of the upper boom 22 and the longitudinal axis of the pivot shaft 34.

While the hydraulic rotary actuator 54 could be fixed to the actuator bracket 52 in various ways, in the illustrated arrangement a plurality of bolts 78 extend through a plurality of holes 80 provided in the mounting plate 74. As best illustrated in FIG. 5, the hole pattern provided in the mounting plate 74 causes the rotary actuator 54 to be mounted on the mounting surface 76 such that the axis of rotation 59 of the rotary actuator 54 is tilted at an acute angle with respect to a central vertical axis bisecting the mounting surface 76 of the mounting plate 74. In the embodiment of the invention illustrated in FIG. 4 the rotary actuator 54 is tipped such that the upper end 82 of the rotary actuator 54 is tilted clockwise. Stated alternatively, the axis 59 of the rotary actuator 54 is tilted rearwardly toward the axis of the pivot shaft 34 and outwardly away from the center line of the upper boom 22.

Figure 4:
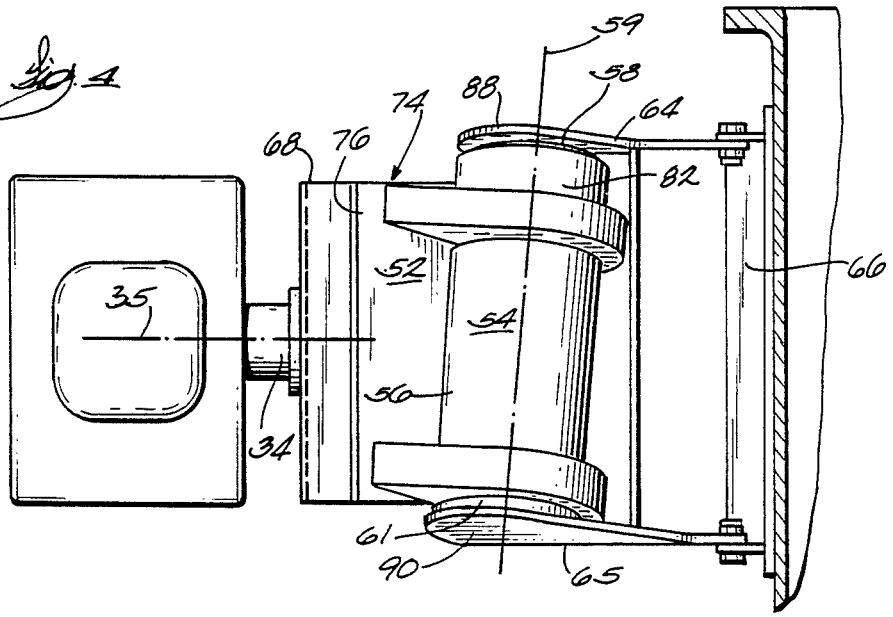
FIG. 4 is an end elevation view of the structure shown in FIG. 3.

As best shown in FIGS. 3–4, the bracket 66 fixed to the bucket 30 includes a pair of vertically spaced apart mounting flanges 64, 65, an end 88 of the upper mounting flange 64 being bolted to the upper end 60 of the rotatable shaft 58 of the rotary actuator 54 and an end 90 of the lower mounting flange 65 similarly being bolted to the lower end 61 of the rotatable shaft 58 of the rotary actuator 54. As shown in FIG. 3, to accommodate the tilt of the rotary actuator 54, the lower mounting flange 65 is longer than the upper mounting flange 64.

When the bucket 30 is in the side hung position 48 as shown in FIG. 3, the center of gravity of the bucket 30 is relatively close to the axis of rotation of the pivot shaft 34. When the bucket 30 rotates forwardly, the center of gravity of the bucket 30 and any load in the bucket moves forwardly and the moment arm on the pivot axis increases. Accordingly, the torque on the pivot pin 34 and the sprocket 40 increases and tensile force is applied to one of the cables 44 and insulating rods of the leveling system. This causes stretching of the leveling cables 44 and insulating rods, and the bucket 30 tilts forwardly. The amount of tilt of the bucket 30 depends on the elasticity of the cable 44 and insulating rods, the length of the articulated boom assembly 12 and the cable 44 and insulating rods, the position of the bucket 30 and the weight of the bucket 30 and the load in the bucket 30. In conventional buckets having an operator of average weight in the bucket, the bucket has been measured as deflecting downwardly approximately 6°–7°.

By mounting the rotary actuator 54 such that its axis of rotation is tipped upwardly, rearwardly and outwardly as described, when the bucket 30 rotates to its forward position, the forward edge of the floor of the bucket will tend to be inclined upwardly. The weight of the bucket and the operator will cause stretching of the leveling cables 44 and insulating rods and will cause the forward edge of the bucket 30 to move downwardly to a level position. When the axis of rotation 59 of the rotary actuator 54 lies in a plane disposed at 45° with respect to the center line of the boom, the angle of incline of the floor of the bucket 31 will be equal to the product of the angle of the tilt of the axis of rotation 59 with respect to the vertical plane of the mounting plate 74 multiplied by the cosine of 45°. The desired tilt angle of the rotational axis 59 of the rotor actuator 54 with respect to a vertical line bisecting the supporting surface can be established by testing the amount of deflection experienced in normal operation of the aerial lift when the bucket is moved from the side hung position 48 to the forward position 50, and then calculating the required relative position of the axis of rotation 59 of the rotary actuator 54 with respect to the vertical mounting surface 76 of the actuator bracket 52. For example, if the deflection of the bucket would be approximately 6° due to the weight of the bucket and its load, the rotary actuator should be mounted at an angle of approximately 4.25° with respect to a vertical line generally bisecting the support surface of the bracket.

Various features of the invention are set forth in the following claims.

We claim:

1. An aerial lift comprising:

a frame, a boom including opposite ends, one of the ends of the boom being supported by the frame, and the boom including a center line, a bucket supported by an opposite end of the boom, means for supporting the bucket for pivoting movement about a horizontal axis, the means for supporting the bucket for pivoting movement including a generally horizontal pivot shaft supported by the other end of the boom, means for supporting the bucket for pivoting movement about a generally vertical axis between a side hung position at one side of the boom and a forward extended position, the means for supporting the bucket for pivoting movement including a rotary actuator having an upper end and a lower end, the rotary actuator including a central axis of rotation, means for connecting the rotary actuator to the bucket for supporting the bucket, and means for supporting the rotary actuator such that the upper end of the axis of rotation of the rotary actuator is tipped rearwardly toward the horizontal axis of the horizontal pivot shaft and outwardly away from the boom.

2. An aerial lift as set forth in claim 1 wherein the means for supporting the rotary actuator includes a bracket mounted on the pivot pin for rotation with the Pivot pin, the bracket including a rotary actuator supporting surface defining a plane disposed at an angle of approximately 45° to the axis of the pivot pin.

3. An aerial lift as set forth in claim 2 wherein the bracket is fixed to the pivot pin, the bracket having opposite ends, one end connected to the pivot pin and the other end including the rotary actuator supporting surface.

4. An aerial lift as set forth in claim 2 wherein the rotary actuator supporting surface of the bracket includes a central vertical axis generally bisecting the supporting surface and wherein the rotary actuator is mounted on the supporting surface such that the axis of rotation of the rotary actuator is generally parallel to the rotary actuator supporting surface and defines an acute angle with respect to the vertical axis generally bisecting the supporting surface.

5. An aerial lift as set forth in claim 4 wherein the axis of rotation of the rotary actuator is inclined at an acute angle with respect to the vertical axis bisecting the supporting surface.

6. An aerial lift comprising:

a boom supported for movement, a platform supported by the boom, means for maintaining the platform generally level during movement of the boom, this means including means for supporting the platform for pivotal movement about a horizontal pivot axis generally perpendicular to the center line of the boom, means for mounting the platform to the end of the boom such that the platform can be pivoted between a side hung position wherein the platform is located laterally of the end of the boom and a forward extended position, the means for mounting the platform including a support member supported by the boom and a rotary actuator supported by the support member, the rotary actuator supporting the platform for rotation about a central axis, the central axis of rotation of the rotary actuator lying in a plane perpendicular to a line bisecting the angle defined by the center line of the boom and the horizontal pivot axis, and wherein the central axis of rotation is inclined upwardly toward the horizontal pivot axis and outwardly away from the center line of the boom.

7. An aerial lift as set forth in claim 6 wherein the means for maintaining the bucket level includes a generally horizontal pivot pin supported by the boom and a bracket supported by the pivot pin, the bracket including a portion supporting the rotary actuator.

8. An aerial lift as set forth in claim 7 wherein the bracket includes a rotary actuator support surface defining a generally vertical plane perpendicular to a line bisecting the angle between the center line of the boom and the horizontal pivot axis.

9. An aerial lift as set forth in claim 8 wherein the rotary actuator is mounted on the support surface of the bracket such that the central axis of rotation is generally parallel to the plane of the support surface and inclined at an acute angle with respect to the vertical center line of the support surface.

* * * * *